US006307815B1

(12) United States Patent
Polosky et al.

(10) Patent No.: US 6,307,815 B1
(45) Date of Patent: Oct. 23, 2001

(54) MICROELECTROMECHANICAL TIMER

(75) Inventors: Marc A. Polosky; Ernest J. Garcia; David W. Plummer, all of Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 09/121,763

(22) Filed: Jul. 23, 1998

(51) Int. Cl.[7] ..... G04B 19/02
(52) U.S. Cl. ..... 368/220
(58) Field of Search ..... 368/220, 47, 187, 368/223

(56) References Cited

U.S. PATENT DOCUMENTS 4,420,263 * 12/1983 Besson et al. ..... 368/80
4,645,357 * 2/1987 Algaier et al. ..... 368/187
5,231,612 * 7/1993 Allgaier et al. ..... 368/47
5,270,993 * 12/1993 Besson et al. ..... 368/80
5,378,583 1/1995 Guckel ..... 430/325
5,566,140 * 10/1996 Kohata et al. ..... 368/187
5,631,514 5/1997 Garcia ..... 310/309
5,930,205 * 7/1999 Baba et al. ..... 368/187

OTHER PUBLICATIONS

U.S. application No. 08/874,815, Garcia, filed Jun. 13, 1997.

* cited by examiner

*Primary Examiner*—Bernard Roskoski
(74) *Attorney, Agent, or Firm*—John P. Hohimer

(57) ABSTRACT

A microminiature timer having an optical readout is disclosed. The timer can be formed by surface micromachining or LIGA processes on a silicon substrate. The timer includes an integral motor (e.g. an electrostatic motor) that can intermittently wind a mainspring to store mechanical energy for driving a train of meshed timing gears at a rate that is regulated by a verge escapement. Each timing gear contains an optical encoder that can be read out with one or more light beams (e.g. from a laser or light-emitting diode) to recover timing information. In the event that electrical power to the timer is temporarily interrupted, the mechanical clock formed by the meshed timing gears and verge escapement can continue to operate, generating accurate timing information that can be read out when the power is restored.

43 Claims, 5 Drawing Sheets

MICROELECTROMECHANICAL TIMER

GOVERNMENT RIGHTS

This invention was made with Government support under Contract No. DE-AC04-94AL85000 awarded by the U.S. Department of Energy. The Government has certain rights in the invention.

FIELD OF THE INVENTION

The present invention relates generally to microelectromechanical (MEM) devices, and in particular to a microelectromechanical timer having an optical readout.

BACKGROUND OF THE INVENTION

Polysilicon surface micromachining adapts planar fabrication process steps known to the integrated circuit (IC) industry to manufacture microelectromechanical or micromechanical devices. The standard building-block processes for polysilicon surface micromachining are deposition and photolithographically patterning of alternate layers of low-stress polycrystalline silicon (also termed polysilicon) and a sacrificial material (e.g. silicon dioxide). Vias etched through the sacrificial layers at predetermined locations provide anchor points to a substrate and mechanical and electrical interconnections between the polysilicon layers. Functional elements of the device are built up layer by layer using a series of deposition and patterning process steps. After the device structure is completed, it can be released for movement by removing the silicon dioxide layers using a selective etchant such as hydrofluoric acid (HF) which does not attack the polysilicon layers.

The result is a construction system generally consisting of a first layer of polysilicon which provides electrical interconnections and/or a voltage reference plane, and up to three or more additional layers of mechanical polysilicon which can be used to form functional elements ranging from simple cantilevered beams to complex systems such as an electrostatic motor connected to a plurality of gears. Typical in-plane lateral dimensions of the functional elements can range from one micron to several hundred microns, while the layer thicknesses are typically about 1–2 microns. Because the entire process is based on standard IC fabrication technology, a large number of fully assembled devices can be batch-fabricated on a silicon substrate without any need for piece-part assembly.

The present invention relates to a microelectromechanical (MEM) timer formed from silicon micromachining technology using MEM electrostatic motors of the type disclosed by Garcia et al in U.S. Pat. No. 5,631,514 which is incorporated herein by reference. In the present invention, a first MEM electrostatic motor is used to intermittently wind a mainspring of the MEM timer. The MEM timer drives a set of meshed timing gears that are encoded so that timing information that can be optically read out. The present invention can also include a second electrostatic motor for starting and stopping the MEM timer.

An advantage of the present invention is that a compact and rugged MEM timer can be formed which, once activated, provides accurate timing information through an optical readout and retains the timing information even though electrical power to the device may be temporarily interrupted.

Another advantage of the present invention is that the MEM timer can provide millisecond timing resolution, and a running time of up to an hour or longer depending upon the number of timing gears provided in a mechanically-driven gear train and how often the mainspring is rewound.

Yet another advantage of the present invention is that the MEM timer provides an optical readout of timing information that can be accessed optically by a plurality of light beams, including light-emitting-diode (LED) or laser beams, transmitted through free space or optical fibers.

Still another advantage of the present invention is that preferred embodiments of the MEM timer can be fabricated without the need for piece part assembly.

These and other advantages of the method of the present invention will become evident to those skilled in the art.

SUMMARY OF THE INVENTION

The present invention relates to a microelectromechanical (MEM) timing apparatus (i.e. a MEM timer) formed on a silicon substrate by surface micromachining processes. The MEM timer includes a main gear formed on the substrate; and a coiled mainspring operatively connected to the main gear to supply mechanical power thereto. A plurality of meshed timing gears is formed on the substrate, and driven by mechanical coupling to the main gear. Rotation (i.e. rotary motion) of each of the meshed timing gears is controlled by a verge escapement mechanism operatively connected to one of the timing gears (e.g. a last-driving timing gear). An optical readout is provided for recovering timing information from the rotary motion of one or more of the timing gears. The mainspring, main gear, and timing gears can all be formed, for example, from deposited and patterned polycrystalline silicon.

The present invention preferably further includes a MEM electrostatic motor for winding the mainspring. The electrostatic motor can be mechanically coupled to the mainspring by a reduction gear train, and by a ring gear attached to one end of the mainspring. Idler gears can be provided for lateral constraint of the ring gear, thereby allowing the ring gear to be formed as an annulus. Additionally, one or more counter-rotation pawls can be provided to limit rotation of the ring gear to single direction as required for winding of the mainspring.

A start/stop switch is also preferably provided for starting and/or stopping operation of the MEM timer. The start/stop switch can be formed by providing a second MEM electrostatic motor that operates to move a catch into or out of engagement with a verge (i.e. the verge escapement mechanism) to stop or enable motion of the timing gears, respectively.

Timing information can be optically read out of the MEM timer by providing an optical encoder (e.g. a binary or gray-scale optical encoder) on each timing gear (e.g. on an upper surface of each timing gear) for determining the rotary position of each timing gear over time. The optical encoder can comprise, for example, a plurality of annular trenches or slots formed into each timing gear. Read out of the timing information from the MEM timer can be accomplished using one or more light beams incident on each timing gear containing an optical encoder so that the light beams are either transmitted through each timing gear (e.g. transmitted through optical encoder slots formed through the timing gears), or alternately reflected or scattered from each timing gear (e.g. reflection or scattering of light from annular trenches formed in each timing gear). The transmitted, reflected or scattered light becomes encoded with timing information that can then be recovered by detecting the light to generate an electrical signal containing the timing information. Each light beam can be, for example, a laser beam or a beam from a light-emitting-diode (LED). The incident light beams and detected light can be coupled into and out from the MEM timer, respectively, by free-space or optical fiber coupling.

Additional advantages and novel features of the invention will become apparent to those skilled in the art upon examination of the following detailed description thereof when considered in conjunction with the accompanying drawings. The advantages of the invention can be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several aspects of the present invention and, together with the description, serve to explain the principles of the invention. The drawings are only for the purpose of illustrating preferred embodiments of the invention and are not to be construed as limiting the invention. In the drawings.

DETAILED DESCRIPTION OF THE INVENTION

Figure 1:
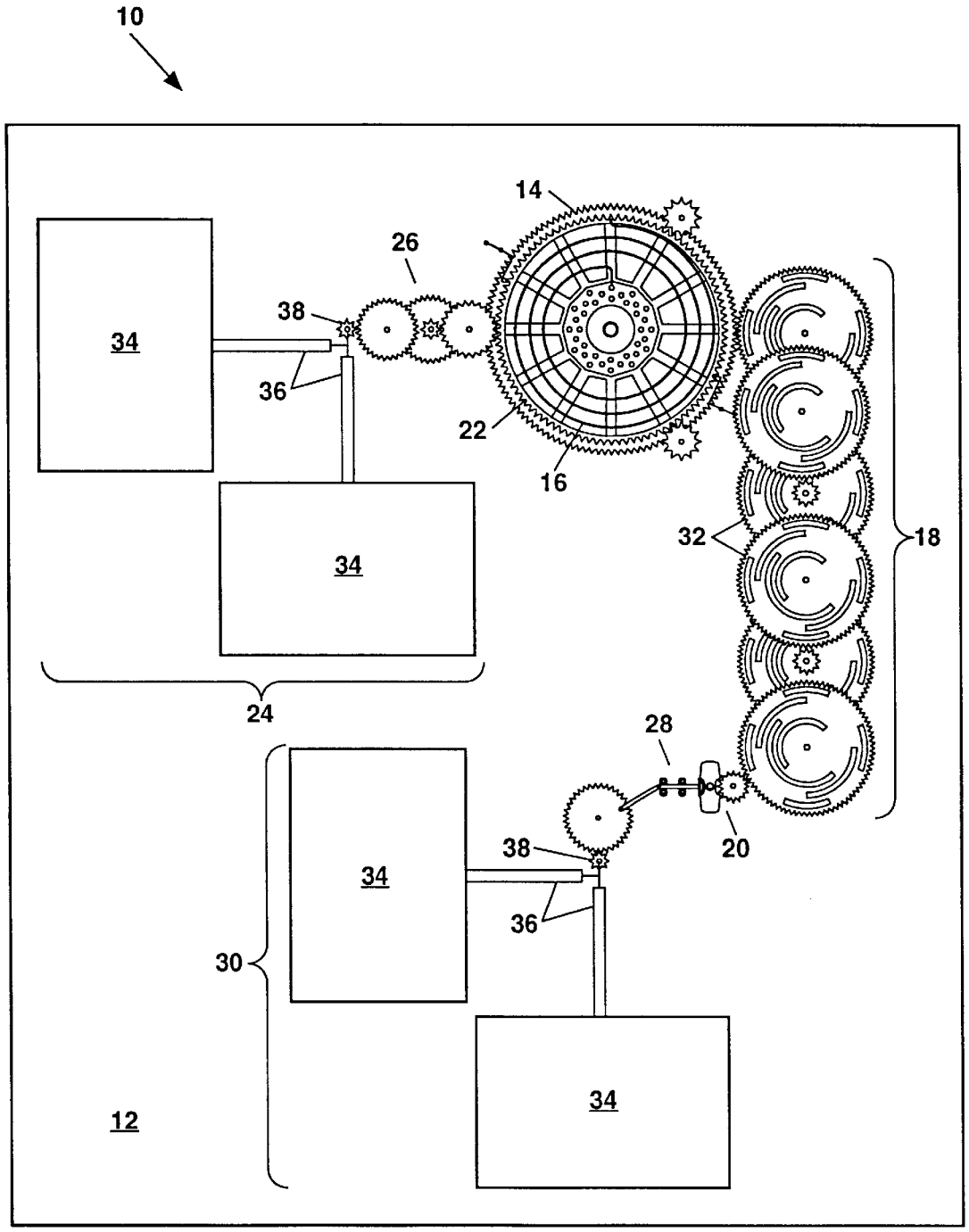
FIG. 1 shows a schematic representation of an embodiment of the MEM timing apparatus of the present invention.

Referring to FIG. 1, there is shown schematically an example of a MEM timing apparatus 10 (hereafter a MEM timer) that is formed monolithically on a substrate 12. In FIG. 1, the MEM timer 10 comprises a main gear 14; a coiled mainspring 16; a first gear train 18 comprising a plurality of meshed timing gears 32; and an escapement mechanism 20. The mainspring 16 is connected at one end to the main gear 14 and at the other end to a ring gear 22 that is used for winding the mainspring 16. A first electrostatic motor 24 is used to rotate the ring gear 22 via a reduction gear train 26, thereby winding the mainspring. In the embodiment of the present invention in FIG. 1, a start/stop switch 28 operated by a second electrostatic motor 30 is used to enable or disable rotation of the timing gears 32 which form a clock having an optical readout.

The embodiment of MEM timer 10 in FIG. 1 can be formed on a silicon substrate 12 using surface micromachining processes. The surface micromachining processes are based on steps for depositing and photolithographically patterning alternate layers of low-stress polycrystalline silicon (also termed polysilicon) and a sacrificial material (e.g. silicon dioxide or a silicate glass) to build up the layer structure of the MEM timer 10 and thereby form each of the mechanical elements and features thereof as shown in FIG. 1. Altogether, four layers (also termed levels herein) of polysilicon are used to form both structural and non-structural films of the MEM timer 10.

The silicon substrate 12 is initially prepared by blanketing the substrate 12 with a layer of thermal oxide (e.g. 630 nanometers thick) formed by a conventional wet oxidation process at an elevated temperature (e.g 1050° C. for about 1.5 hours). A layer of low-stress silicon nitride (e.g. 800 nanometers thick) is then deposited over the thermal oxide layer using low-pressure chemical vapor deposition (LPCVD) at about 850° C. The thermal oxide and silicon nitride layers provide electrical isolation from the substrate for a subsequently-deposited first polysilicon layer.

A first polysilicon layer is deposited over the substrate 12, blanketing the silicon nitride layer which can be patterned to provide one or more vias or through holes so that the first polysilicon layer can electrically contact the substrate 12. The polysilicon deposition can be performed by LPCVD at a temperature of about 580° C. Phosphorous doping can be used to make the first polysilicon layer and other overlying polysilicon layers electrically conductive as needed (e.g. for forming electrostatic motors or actuators, and electrical interconnections thereto). The first polysilicon layer can be about 300 nanometers thick, and is used to form a voltage reference plane for electrical elements on the substrate 12 (e.g. electrostatic comb actuators 34 of the motors 24 and 30). An additional three layers of polysilicon are used to form the MEM timer 10 in the example of FIG. 1. These three additional polysilicon layers are also preferably deposited by LPCVD, with typical layer thicknesses on the order of 0.5–2 $\mu$m.

The polysilicon layers are separated by sacrificial layers of silicon dioxide or silicate glass (e.g. a plasma-enhanced CVD oxide, also termed PECVD oxide; or a silicate glass deposited from the decomposition of tetraethylortho silicate, also termed TEOS, by LPCVD at about 750° C., and densified by a high temperature processing) having predetermined layer thicknesses (e.g. 0.5–2 $\mu$m) as required for separating functional elements (e.g. gears) to be formed in the polysilicon layers.

The sacrificial layers are deposited to cover each succeeding polysilicon layer as needed, and to fill in spaces between the functional elements or features thereof formed in the polysilicon layers. One or more of the sacrificial layers can be planarized by chemical-mechanical polishing (CMP) to precisely adjust the thickness of the sacrificial layers, or to eliminate the formation of stringers which can otherwise result in mechanical interferences between functional elements formed in adjacent polysilicon layers. Without the use of chemical-mechanical polishing, the surface topography would become increasingly severe as each succeeding polysilicon or sacrificial layer is deposited upon an underlying patterned layer of material.

After each CMP process step, the resulting planarized sacrificial layer can be patterned by photolithographic definition and etching steps (e.g. reactive ion etching) to provide shaped openings for the subsequent deposition of an overlying layer of polysilicon. These shaped openings can be used for molding of the functional elements (e.g. gears) or features thereof from the subsequently deposited polysilicon, or to form vias (i.e. through holes) wherein polysilicon can be deposited to interconnect adjacent polysilicon layers. Additionally, one or more of the patterned sacrificial layers can be used as an etch mask for anisotropically etching an underlying polysilicon layer.

Mechanical stress can accumulate due to successive depositions of the polysilicon and sacrificial material resulting in distortion or bowing of the substrate or wafer. It is essential to relieve stress in the polysilicon layers to provide planar surfaces for large functional elements such as the main gear 14, the ring gear 22, and the first gear train 18 comprising a plurality of meshed timing gears 32. Normally, each added structural polysilicon layer is annealed at a temperature of about 1100° C. for three hours in order to relieve stress in the polysilicon layer prior to photolithographically defining that layer.

To build up the structure of the MEM timer 10, a series of polysilicon or sacrificial layer deposition, photolithographic definition, and etching process steps are repeated multiple times. After these repeated fabrication steps, the MEM timer 10 can then be released for operation by selectively etching away the sacrificial layers using a selective etchant such as hydrofluoric acid (HF) that does not chemically attack the polysilicon layers. For this purpose, a plurality of spaced access holes (not shown) are formed through the polysilicon layers and functional elements formed therein to expose each underlying sacrificial layer to the selective etchant so that the sacrificial material can be uniformly removed. The use of an annular shape for the ring gear 22 and spoked gears (e.g. main gear 14) also aids in removal of the underlying sacrificial material by selective etching.

In FIG. 1, the electrostatic motors, 24 and 30, are of conventional design and comprise a pair of linear electrostatic actuators 34 (i.e. electrostatic comb-drive actuators) formed on the substrate 12 at right angles to each other with linkages 36 connected to an off-axis pin joint of an output gear 38. The electrostatic actuators 34 are electrically driven by providing oscillatory voltage drive signals to the actuators 34 that are 90° out of phase so that each actuator 34 is alternately driven through a range of forward or backward motion to rotate the output gear 38 in substantially 90° increments. Further details of electrostatic motors, 24 and 30, can be found in U.S. Pat. No. 5,631,514 to Garcia et al.

Figure 2:
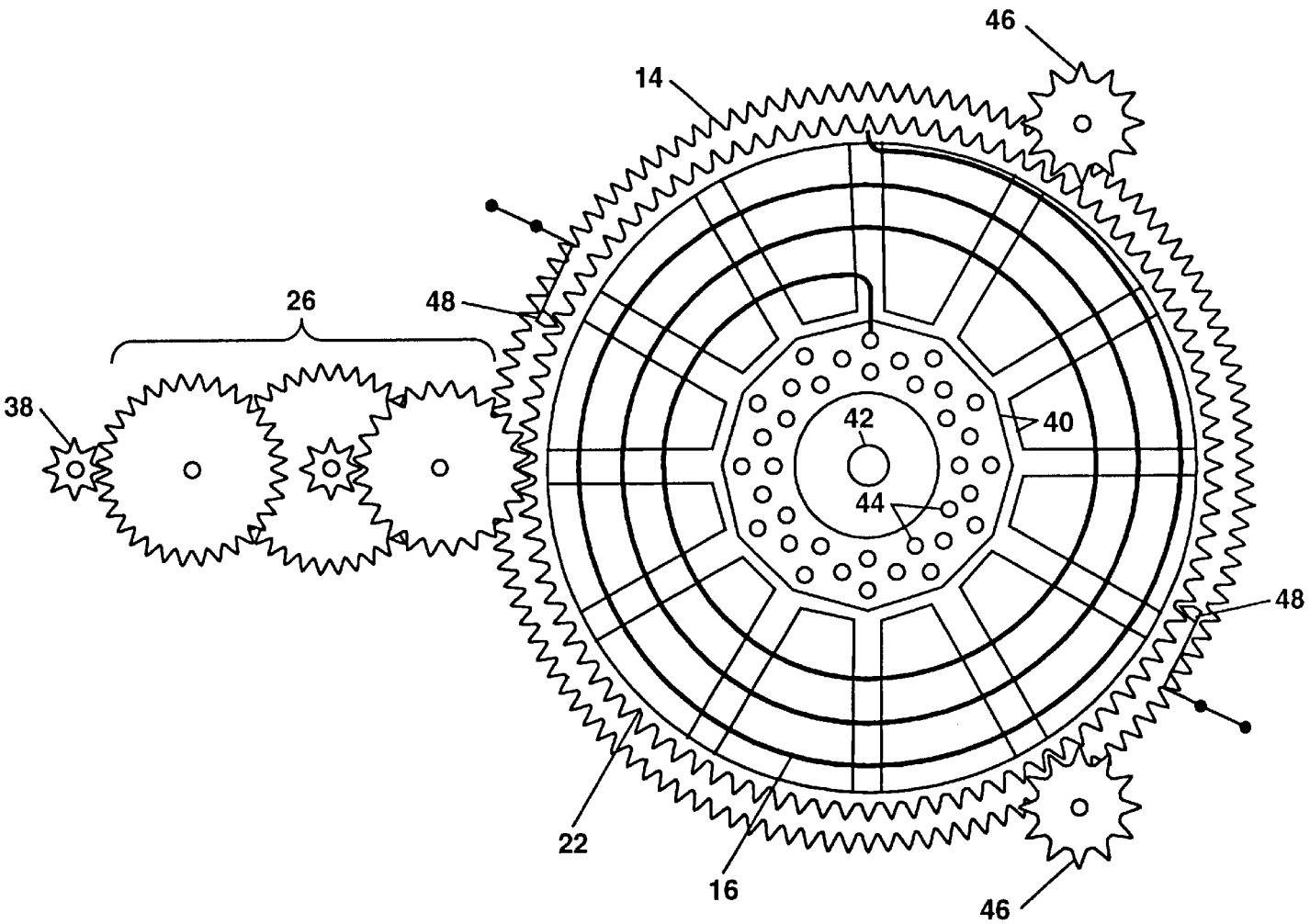
FIG. 2 shows an enlarged view of a mechanical power source portion of the MEM timer of FIG. 1.

FIG. 2 shows an enlarged view of a mechanical power source portion of the MEM timer 10 that includes main gear 14, mainspring 16, ring gear 22, second set of meshed gears 26 and the electrostatic motor output gear 38. In FIG. 2, the main gear 14 comprises a hub 40 rotatable about a pin joint shaft 42, with gear teeth formed about the periphery of the main gear 14. The main gear 14 can be formed primarily in a second polysilicon layer using the surface micromachining processes described heretofore, with a portion of the hub 40 extending upward into the third polysilicon layer to provide an attachment point for one end of the mainspring 16. The extended portion of the hub 40 in the third polysilicon layer can be attached to the remainder of the hub 40 in the second polysilicon layer using a plurality of vias 44 etched through the intervening sacrificial material. Polysilicon deposited in the vias during deposition of the third polysilicon layer then forms mechanical interconnections between the second and third polysilicon layers forming the hub 40 after removal of the intervening sacrificial material by selective etching.

In FIG. 2, the mainspring 16 can be formed from the third polysilicon layer. One end of the spiral mainspring 16 is attached to the hub 40 of the main gear 14; and the other end of the mainspring 16 is attached to the ring gear 22 which can also be formed from the third polysilicon layer. The attachment can be accomplished by blanket depositing the third polysilicon layer and patterning the layer by etching through a patterned etch mask so that the unetched polysilicon remaining in the third layer forms the interconnected ring gear 22, mainspring 16 and extended portion of the hub 40.

The ring gear 22 in FIG. 2 is formed without any hub or shaft. Instead, the ring gear 22 is supported and laterally constrained by a drive gear in the reduction gear train 26 and by a pair of idler gears 46 equally spaced (i.e. with a 120° angular separation) about the ring gear 22. Polysilicon tabs (not shown) can be formed in a fourth polysilicon layer over the idler gears 46 and the drive gear to constrain vertical movement of the ring gear 22. In other embodiments of the present invention, the locations of the ring gear 22, mainspring 16 and main gear 14 can be reversed so that the ring gear 22 and mainspring 16 are formed in the second polysilicon layer and the main gear 14 is primarily formed in the third polysilicon layer. This would have the advantage of eliminating the need for tabs to vertically constrain the ring gear 22.

To wind the mainspring 16, the first electrostatic motor 24 is activated by 90°-out-of-phase voltage drive signals, with output gear 38 driving the reduction gear train 26 (also termed a transmission) to rotate the ring gear 22 in the counterclockwise direction for the embodiment of the present invention shown in FIGS. 1 and 2. The mainspring 16 can be initially wound by the first electrostatic motor 24 to store mechanical energy which can then be used to supply power to the main gear 14. The first electrostatic motor 24 can be used to periodically re-wind the mainspring 16 as needed during operation of the MEM timer 10.

The reduction gear train can comprise a plurality of compound gears that are formed from a small-toothed gear fabricated in one of the second or third polysilicon layers interconnected with a large-toothed gear fabricated in the other of the second and third polysilicon layers. Adjacent gears of the reduction gear train can be oppositely oriented to provide for meshing of the gears with a predetermined gear reduction ratio (e.g. 140:1). Additionally, dimples (not shown in FIG. 2) can be provided in the compound gears of the reduction gear train (or in other gears within the MEM timer 10) to provide a more precise vertical tolerancing of the gears (i.e. to limit wobbling of the gears during rotation). Such dimples can be formed, for example, by etching wells or trenches in the underlying sacrificial material prior to deposition of a polysilicon layer.

In FIG. 2, one or more optional counter-rotation pawls 48 formed of polysilicon can be provided to prevent the possibility of unwinding of the mainspring 16 by counter rotation of the ring gear 22. The counter-rotation pawls 48 comprise a spring-loaded interdental stop which is shaped to allow rotation of the ring gear 22 in the winding direction, while preventing rotation in the opposite direction.

Figure 3:
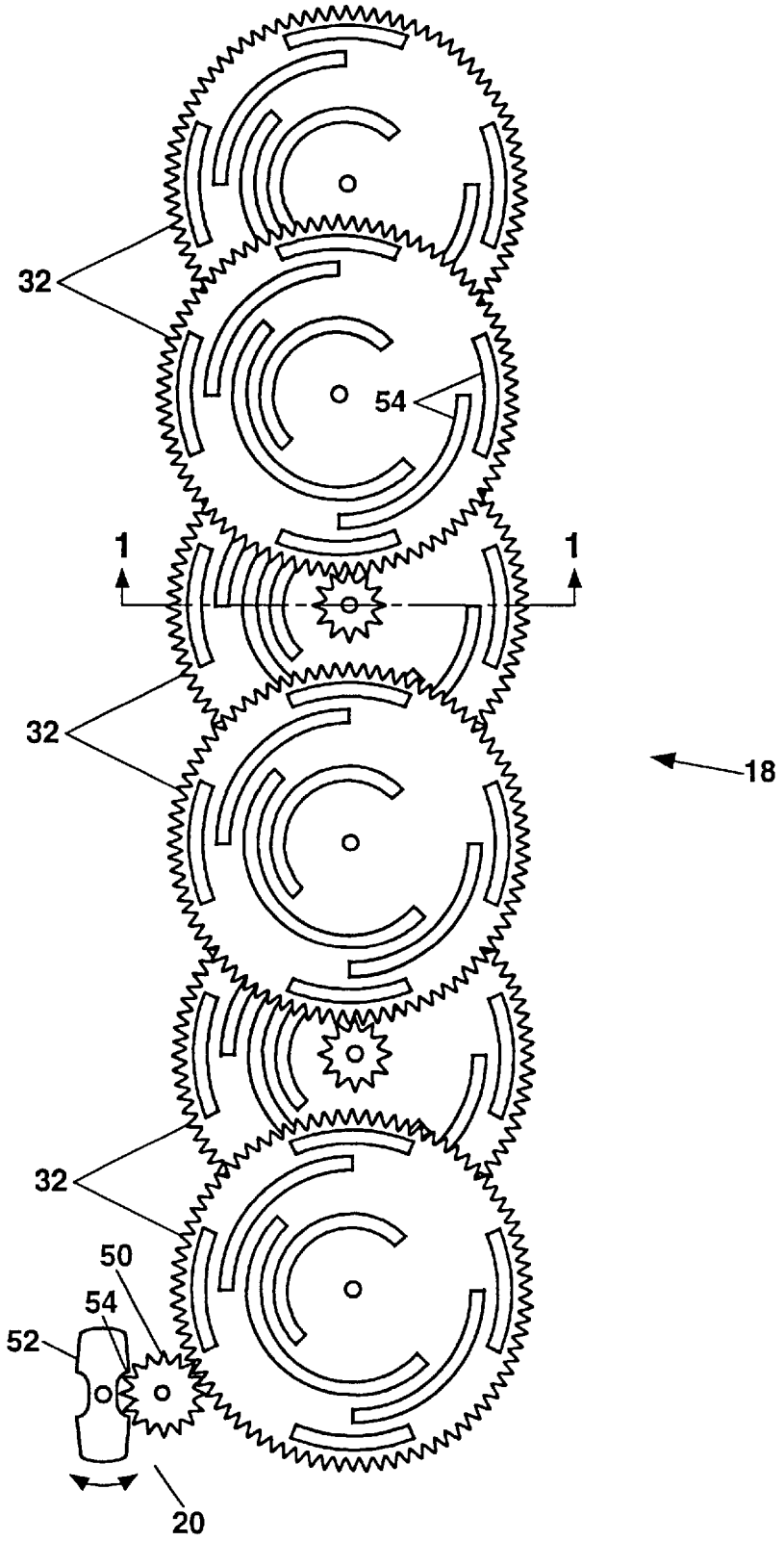
FIG. 3 shows an enlarged view of a clock portion of the MEM timer of FIG. 1.

FIG. 3 shows an enlarged view of a clock portion of the MEM timer of FIG. 1. The clock portion comprises the first gear train 18 which includes the plurality of meshed timing gears 32 and is driven by the main gear 14 and mainspring 16. The clock portion further includes the verge escapement mechanism 20 comprising an escape wheel 50 and a verge 52. The verge 52 dampens rotary motion of the meshed timing gears 32 so that the timing gears each run at a substantially constant angular velocity.

A first timing gear meshed with the main gear 14 (see FIG. 1) can be formed as a simple gear (i.e. from a single polysilicon layer). The remaining timing gears 32 in FIG. 3 are complex gears comprising a small-toothed gear formed in one of the second or third polysilicon layers interconnected with a large-toothed gear formed in the other of the second and third polysilicon layers.

Each successively driven timing gear 32 rotates at a higher rate, thereby providing a higher level of timing accuracy. The exact number of timing gears 32 and the reduction ratio for each timing gear 32 is preselected to provide a predetermined level of timing accuracy. For example, if the ratio of the number of teeth of the small-toothed gear and the large-toothed gear in each compound gear were 10:1, then each additional compound timing gear 32 would provide an additional decimal point in the accuracy of the timing information provided by the MEM timer 10.

Each timing gear 32 is provided with an optical readout which can comprise an optical encoder as shown in FIG. 3. The optical encoder can be a binary optical encoder as shown in FIG. 3, or a gray-scale optical encoder or any other type of optical encoder known to the art. The optical encoder can be formed within each timing gear during fabrication of the timing gear by surface micromachining (e.g. by patterning and etching the polysilicon layer after deposition thereof).

In the embodiment of the present invention in FIG. 3, the optical encoder is shown as a binary encoder which can be formed by patterning and etching a plurality of annular trenches or slots 54 that extend downward into or through the polysilicon layer used to form the first timing gear 32, and also similarly patterning and etching the polysilicon layer used to form the large-toothed gear of each of the remaining compound timing gears 32. Light beams incident onto the timing gears 32 can be encoded with the timing information; and a transmitted, reflected or scattered portion of each light beam can be detected to recover the timing information.

Figure 4A:
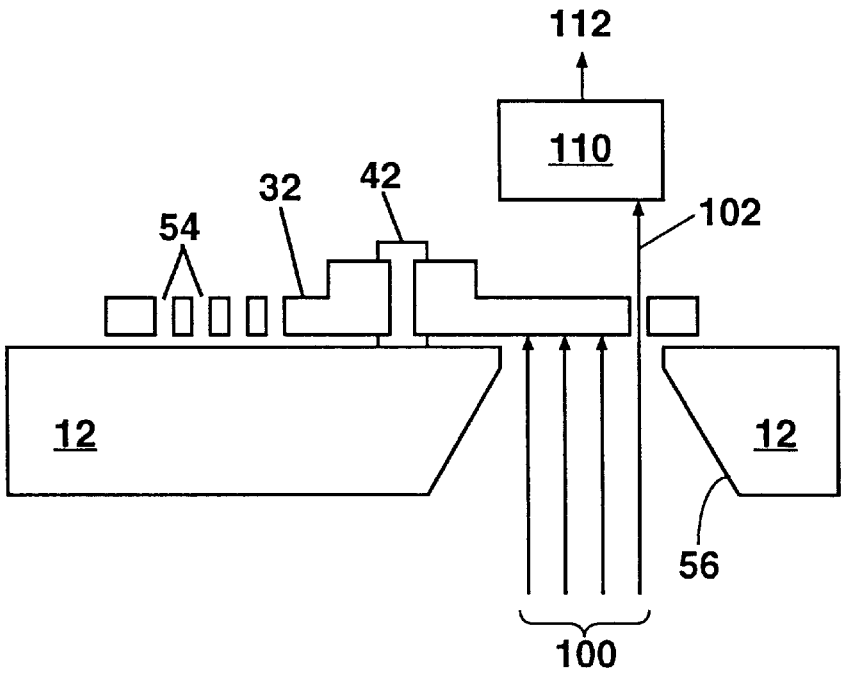
FIGS. 4*a* and 4*b* show schematic cross-section views along the line 1—1 in FIG. 3, illustrating the use of an incident light beam for recovering timing information.
Figure 4B:
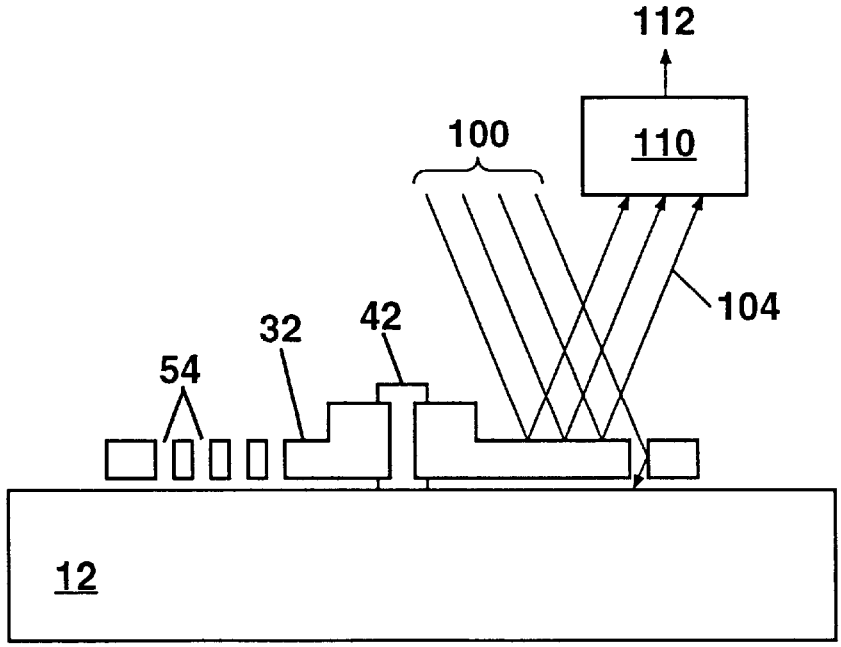

FIGS. 4*a* and 4*b* show schematic cross-section views of one of the timing gears 32 through cross-section 1—1 in FIG. 3 and through the substrate 12 (not shown in FIG. 3) to illustrate the use of one or more incident light beams 100 to recover the timing information from the MEM timer 10. According to one embodiment of the present invention, the incident light beams 100 from a laser (e.g. a vertical-cavity surface-emitting laser) or a light-emitting diode (LED) can be directed upwards as shown in FIG. 4*a* (or alternately downwards) to pass through one or more slots 54 defining the optical encoder formed in the timing gear 32, and also to pass through an etched through-hole 56 (e.g. formed by wet or dry etching, or a combination thereof) in the silicon substrate 12. The solid lines with arrows indicated as 100 can represent either a plurality of spaced light beams, or a plurality of light rays forming a single light beam.

In FIG. 4*a*, a portion 102 of the incident light beam 100 is transmitted through one or more of the slots 54 thereby encoding the transmitted light portion 102 with timing information corresponding to rotary motion of the timing gear 32. The transmitted light portion 102 encoded with the timing information can then be detected by one or more photodetectors 110 (e.g. a photodetector array) to generate an electrical signal 112 containing the timing information.

In another embodiment of the present invention shown in FIG. 4*b*, one or more incident light beams 100 can be directed at a predetermined angle to each timing gear 32 so that a reflected or scattered light portion 104 can be encoded with the timing information and detected by photodetector 110 to generate an electrical signal 112 containing the timing information. In this embodiment of the invention, any of the light that is incident on the trenches or slots 54 in the timing gear 32 will be scattered or redirected, thereby reducing the magnitude of the light portion 104 that is detected by photodetector 110. The light 100 incident on an upper surface of the timing gear 32 will be reflected onto the photodetector 110 as shown in FIG. 4*b*.

This discussion of the formation and use of the optical encoders to recover timing information from the MEM timer 10 is illustrative. It will be understood by those skilled in the art that other types of optical encoders can be formed to read out the timing information from the MEM timer 10 of the present invention, and other types of information recovery schemes can be used. For example, an optical encoder can be formed with a plurality shaped protrusions (e.g. annular mesas) extending slightly out from the surface of the timing gears 32 by patterning and etching the upper surface of the timing gears 32 to remove material and thereby recess the surface except at locations corresponding to the shaped protrusions. As another example, an optical encoder can be formed by simply using the gear teeth of each timing gear 32 to interrupt, reflect or scatter light from an incident light beam 100, thereby modulating the light at a frequency corresponding to the rotation rate of the timing gear 32 multiplied by the number of teeth on the timing gear 32.

In the example of FIG. 3, the first timing gear 32 can be formed in the second polysilicon layer. The large-toothed gear of each successive compound timing gear 32 can be formed alternately from the third or the second polysilicon layer. The exact number of timing gears 32 needed for the MEM timer 10 can be selected depending upon the timing precision required. In FIG. 3, six timing gears 32 are shown, each mounted on a pin-joint shaft 42 formed in the second, third and fourth polysilicon layers. An enlarged portion of each shaft 42 above each timing gear is provided to retain the gear and limit vertical play. Since only a limited field of view is needed to read out the rotary position of the timing gears 32 using the optical encoder, the overlap of the meshed timing gears 32 does not generally present a problem in reading out the timing information from each gear 32.

In FIG. 3, the timing gears 32 are driven by the main gear 14 and mainspring 16, with an escapement mechanism 20 comprising an escape wheel 50 and a verge 52 formed in the second and third polysilicon layers. The escapement mechanism 20 dampens and regulates rotation of the timing gears 32, thereby forming a clock. Cyclic back and forth motion of the verge 52 about a shaft is produced by contact of teeth of the escape wheel 50 with pallets 54 of the verge 52. A polysilicon spring can optionally be provided for the verge 52 (e.g. by forming a helical or leaf spring in the second polysilicon layer underlying a verge 52 formed in the third polysilicon layer, with one end of the spring connected to one end of the verge 52 and the other end of the spring connected to an anchor point in the second polysilicon layer).

Figure 5:
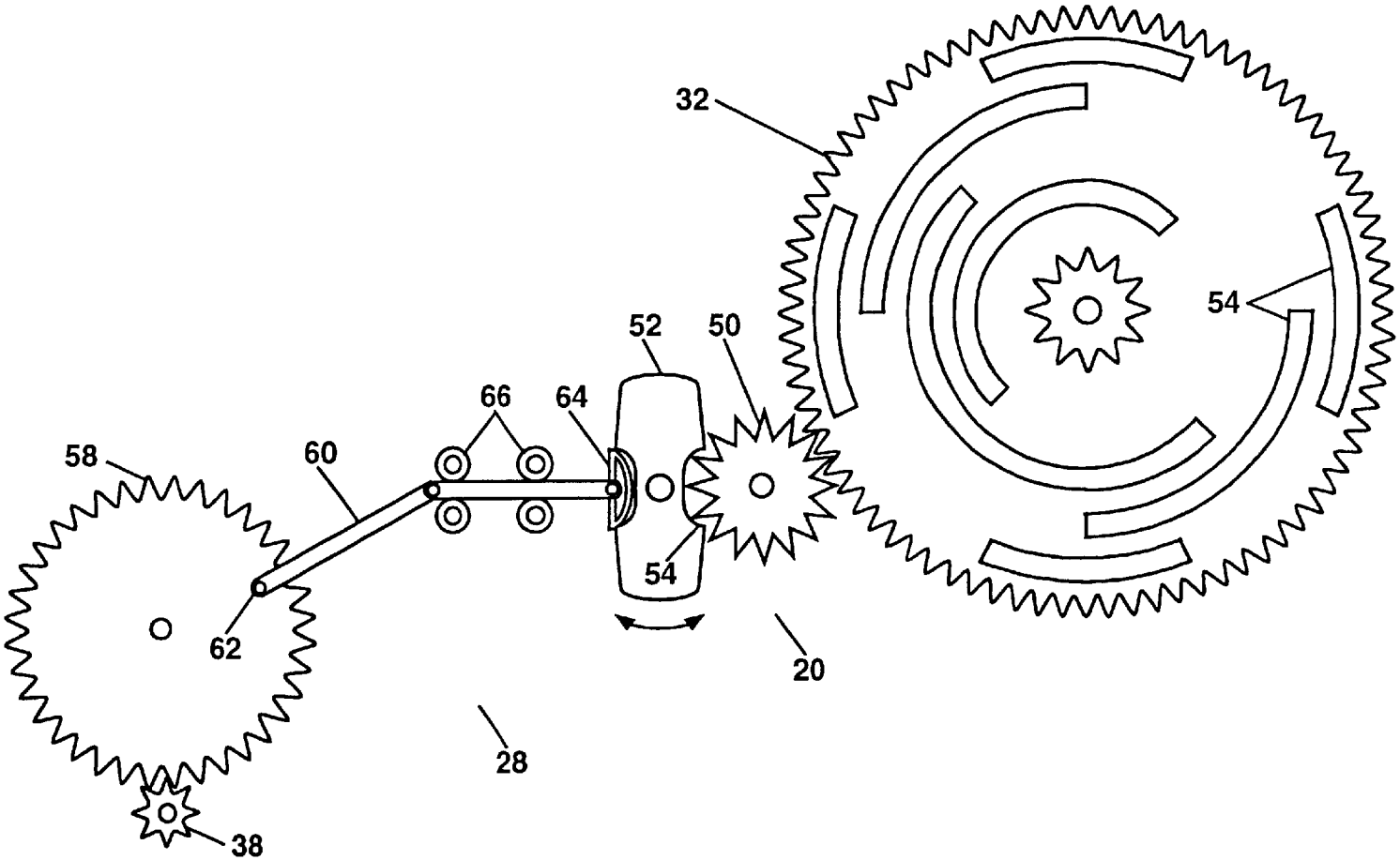
FIG. 5 shows an enlarged view of a start/stop switch portion of the MEM timer of FIG. 1.

FIG. 5 shows a start/stop switch portion of the MEM timer 10 of FIG. 1. In FIG. 5, a start/stop switch 28 is operated by the second electrostatic motor 30 (see FIG. 1) having output gear 38. The output gear 38 rotates locking gear 58 which is connected to a hinged arm 60 at an off-axis pin joint 62. The other end of the hinged arm 60 is connected to a catch 64 which is constrained to move in a linear direction by roller bearings 66 provided on either side of the hinged arm 60 as shown in FIG. 5. Rotation of the locking gear 58 over a predetermined direction and angle of rotation can move the catch 64 into contact with the verge 52 to stop operation of the clock by preventing motion of verge 52 and interconnected escape wheel 50 and timing gears 32. By further rotating the locking gear 58 or by reversing its direction of rotation, the catch 64 can be moved out of contact with the verge 52, thereby enabling operation of the clock by allowing rotation of the escape wheel 50 and timing gears 32.

In other embodiments of the present invention, alternate types of start/stop switches 28 can be used. For example, a linear electrostatic actuator 34 can be used to move the catch 64 into or out of contact with the verge 52 using the hinged arm 60 which can be pivoted about a pin joint to form a lever for magnifying an extent of movement of the catch 64 or an amount of force which the catch 64 applies in contacting the verge 52. As another example, a start/stop switch can be formed by providing a linear electrostatic actuator 34 that moves a catch into or out of engagement with a stop formed on the main gear 14 or on one of the timing gears 32.

The entire MEM timer 10 of FIG. 1 is extremely compact and can be fabricated on a substrate 12 that is less than 5 millimeters square. The MEM timer can be packaged hermetically (e.g. in a TO-8 can or a fiber-optics package) to form a rugged apparatus which can be used for various short-term timing applications. In the event that electrical power to the MEM timer 10 is temporarily interrupted, the clock formed by the meshed timing gears 32 and the escapement mechanism 20 can continue to operate, retaining the timing information encoded by the rotary motion of the timing gears 32. When electrical power is restored, the timing information can be read out of the MEM timer 10.

The matter set forth in the foregoing description and accompanying drawings is offered by way of illustration only and not as a limitation. As described herein, the four-step polysilicon process for forming the MEM timer 10 can use many individual photolithographic reticles (i.e. masks) for defining the various mechanical elements and features thereof as shown in FIGS. 1–5, and can further comprise up to hundreds of individual process steps. Only the handful of process steps that are relevant to the present invention have been described herein; and only the relevant features of the MEM timer 10 have been illustrated and discussed with reference to FIGS. 1–5. Those skilled in the art will understand the use of conventional surface micromachining process steps of polysilicon and sacrificial layer deposition, photolithographic definition, and reactive ion etching which have not been described herein in great detail.

The MEM timer 10 of the present invention can also be scaled to operate in the millimeter domain with each element of the timer 10 scaled up to millimeter-size dimensions. The various elements of the timer 10 can be formed by substituting LIGA ("Lithographic Galvanoforming Abforming", an acronym which evolved from the Karlsruhe Nuclear Research Center in Germany) fabrication processes as disclosed, for example, in U.S. Pat. No. 5,378,583 to Guckel et al which is incorporated herein by reference, for the surface micromachining processes described heretofore. In fabrication of a millimeter-size timer 10 by LIGA processes, a silicon substrate is preferred. The various elements of the timer 10 in FIGS. 1–5 including the gears and the verge escapement mechanism 20 can be alternately formed by a series of LIGA process steps including patterning of a polymethyl methacrylate (PMMA) sheet resist and metal electroplating (e.g. nickel or copper). Using LIGA processes, the gears and verge escapement mechanism 20 are generally formed separately and assembled on the silicon substrate 12 using either silicon shafts formed by patterning and etching the substrate 12, or using metal pins inserted into holes formed at predetermined locations on the substrate. Additionally, for a millimeter domain timer 10, electromagnetic motors can be substituted for the first and second electrostatic motors, 24 and 30, respectively in FIG. 1. Details of electromagnetic motors formed by LIGA processses can be found in U.S. Pat. No. 08/874,815 to Garcia et al which is incorporated herein by reference.

Other applications and variations of the MEM timing apparatus of the present invention will become evident to those skilled in the art. The actual scope of the invention is intended to be defined in the following claims when viewed in their proper perspective based on the prior art.

What is claimed is:

1. A timing apparatus, comprising:

(a) a coiled mainspring;

(b) a timing gear comprising an optical encoder, and operatively connected to the coiled mainspring for rotation of the timing gear;

(c) an escapement mechanism operatively connected to the timing gear for regulating the rotation of the timing gear;

(d) a silicon substrare whereon the mainspring, the timer gear and the escapement mechanism are located;

(e) an electrostatic motor operatively connected to one end of the mainspring by a ring gear and a reduction gear train to wind the mainspring; and (f) means for reading out the optical encoder to recover timing information from the rotation of the timing gear.

2. The apparatus of claim 1 wherein the mainspring comprises polycrystalline silicon.

3. The apparatus of claim 1 wherein the motor operates intermittently to wind the mainspring.

4. The apparatus of claim 1 further comprising switch means for starting and stopping rotation of the timing gear.

5. The apparatus of claim 1 wherein the escapement mechanism comprises a verge.

6. The apparatus of claim 1 wherein the means for reading out the optical encoder comprises a light beam incident on the timing gear.

7. The apparatus of claim 6 wherein the light beam comprises a laser beam.

8. The apparatus of claim 6 wherein the light beam comprises a light-emitting diode (LED) beam.

9. The apparatus of claim 1 wherein the optical encoder comprises a plurality of annular trenches or slots formed in the timing gear.

10. A timing apparatus, comprising:

(a) a silicon substrate;

(b) a main gear formed on the silicon substrate;

(c) a coiled mainspring formed on the substrate and operatively connected to the main gear to supply mechanical power thereto;

(d) a plurality of meshed timing gears formed on the substrate and mechanically coupled to the main gear to provide for rotary motion of the timing gears;

(e) an escapement mechanism operatively connected to one of the timing gears to regulate the rotary motion of the timing gears; and (f) readout means for recovering timing information from the rotary motion of the timing gears.

11. The apparatus of claim 10 further comprising means for winding the mainspring.

12. The apparatus of claim 11 wherein the means for winding the mainspring comprises a first motor mechanically coupled to the mainspring by a reduction gear train driving a ring gear connected to one end of the mainspring.

13. The apparatus in claim 12 wherein the first motor is an electrostatic motor.

14. The apparatus of claim 12 further comprising a counter-rotation pawl to limit the ring gear to a single direction of rotation for winding the mainspring.

15. The apparatus of claim 12 further comprising a plurality of idler gears meshed with the ring gear to laterally constrain the ring gear.

16. The apparatus of claim 10 wherein the mainspring comprises polycrystalline silicon.

17. The apparatus of claim 10 wherein the main gear comprises polycrystalline silicon.

18. The apparatus of claim 10 wherein each gear in the first gear train comprises polycrystalline silicon.

19. The apparatus of claim 10 wherein the escapement mechanism comprises a verge.

20. The apparatus of claim 10 wherein the readout means comprises optical readout means for determining a rotary position of each timing gear.

21. The apparatus of claim 20 wherein the optical readout means further comprises at least one light beam incident on each timing gear for determining the rotary position of each timing gear and thereby recovering the timing information.

22. The apparatus of claim 21 wherein each incident light beam comprises a laser beam.

23. The apparatus of claim 21 wherein each incident light beam comprises a light-emitting diode (LED) beam.

24. The apparatus of claim 20 wherein the optical readout means comprises an optical encoder formed on each timing gear.

25. The apparatus of claim 24 wherein the optical encoder comprises a plurality of annular trenches or slots formed in each timing gear.

26. The apparatus of claim 25 wherein the optical readout means further comprises at least one light beam incident on each timing gear to read out the optical encoder and thereby recover the timing information.

27. The apparatus of claim 26 wherein each incident light beam comprises a laser beam.

28. The apparatus of claim 26 wherein each incident light beam comprises a light-emitting diode (LED) beam.

29. The apparatus of claim 26 wherein the optical readout means further comprises at least one photodetector for detecting a portion of the light beam and generating an electrical signal containing the timing information.

30. The apparatus of claim 10 further including switch means for starting or stopping rotary motion of the timing gears.

31. The apparatus of claim 30 wherein the switch means comprises a catch moveable into or out from contact with a verge of the escapement mechanism.

32. The apparatus of claim 31 wherein the switch means is activated by a second motor.

33. The apparatus of claim 32 wherein the second motor is an electrostatic motor.

34. A timing apparatus, comprising:

(a) a main gear;

(b) a coiled mainspring connected at a first end thereof to the main gear to supply mechanical power thereto;

(c) an electrostatic motor operatively connected to a second end of the mainspring to wind the mainspring and store mechanical power therein; and (d) a plurality of meshed timing gears driven by the main gear, each timing gear rotating at a substantially constant angular velocity and having an optical encoder formed therein for providing timing information from rotary motion of that timing gear.

35. The apparatus of claim 34 further comprising a substrate whereon each of the main gear, the mainspring, the electrostatic motor, the meshed timing gears and the switch means are formed by surface micromachining.

36. The apparatus of claim 35 wherein the substrate comprises silicon.

37. The apparatus of claim 35 wherein each of the main gear, the mainspring and the meshed timing gears are formed from polycrystalline silicon.

38. The apparatus of claim 34 wherein the substantially constant angular velocity of the timing gears is provided by an escapement mechanism engaged with one of the timing gears.

39. The apparatus of claim 38 wherein the escapement mechanism comprises a verge.

40. The apparatus of claim 34 wherein the operative connection between the electrostatic motor and the second end of the mainspring is provided by a reduction gear train driven by the electrostatic motor, and a ring gear driven by the reduction gear train.

41. The apparatus of claim 34 wherein each optical encoder is read out by at least one light beam.

42. The apparatus of claim 41 wherein each optical encoder comprises a plurality of trenches or slots formed in the timing gear.

43. The apparatus of claim 34 further comprising switch means for starting and stopping the rotation of the timing gears.

* * * * *